United States Patent [19]

Bakewell

[11] Patent Number: 4,954,225

[45] Date of Patent: Sep. 4, 1990

[54] METHOD FOR MAKING NOZZLE PLATES

[75] Inventor: Joseph J. Bakewell, Boxford, Mass.

[73] Assignee: Dynamics Research Corporation, Wilmington, Mass.

[21] Appl. No.: 463,261

[22] Filed: Jan. 10, 1990

[51] Int. Cl.[5] ..... C25D 1/08

[52] U.S. Cl. ..... 204/11

[58] Field of Search ..... 204/11

[56] References Cited

U.S. PATENT DOCUMENTS

| | | | |
|---|---|---|---|
| 4,184,925 | 1/1980 | Kenworthy | 204/11 |
| 4,229,265 | 10/1980 | Kenworthy | 204/11 |
| 4,839,001 | 6/1989 | Bakewell | 204/11 |

*Primary Examiner*—T. M. Tufariello

*Attorney, Agent, or Firm*—Weingarten, Schurgin, Gagnebin & Hayes

[57] ABSTRACT

A method for fabricating a nozzle plate having three dimensional features is provided. On a conductive surface, a plurality of non-conductive masked areas of selected dimensions are formed at locations corresponding to the locations of the holes of the desired nozzle plate. A layer of a first metal is electroformed onto the conductive surface until the layer of the first metal overgrows the masked areas by a selected amount. A first layer of a second metal is then electroformed over the layer of the first metal until a plurality of holes having diameters corresponding to the diameters of the holes of the desired nozzle plate are formedin the first layer of the second metal. Depressions formed in the first and second metal layers during the plating process are filled with a planarizing filler. A second layer of the second metal is then electroformed onto the first layer of the second metal to form a plurality of holes in registration with the depressions. Each hole formed in the second layer of the second metal has a selected diameter larger than the holes formed in the first layer of the second metal. The metal layers are then removed from the conductive surface and the non-conductive masked areas and the layer of the first metal are removed from the first and second layers of the second metal.

9 Claims, 2 Drawing Sheets

METHOD FOR MAKING NOZZLE PLATES

FIELD OF THE INVENTION

The present invention generally relates to nozzle plates, and more particularly to nozzle plates having three dimensional features.

BACKGROUND OF THE INVENTION

Nozzle plates having small, closely spaced holes are used in many industrial applications, including in printheads for ink jet printers. Typically, nozzle plates for ink jet printers are comprised of thin sheets of metal with patterns of very small, closely spaced holes. Because of the thinness of the metal sheets and the small size and close spacing of the holes, fabrication of nozzle plates is extremely difficult. Furthermore, such printheads known in the art present various problems usually manifested as poor resolution or blurry imaging.

An ink jet print head of an advanced nature and typical of current ink jet printing heads is disclosed in U.S. Pat. No. 4,555,717 to Miuro, et al. which discloses the use of pressure and potential gradients in combination with small, closely spaced holes to provide ink jet printing of a higher quality than previously known. Miura presents a laminar air flow chamber having a front channel through which a combined stream of air and ink droplets is discharged toward a writing surface. A rear channel provided through an insulative plate and axially aligned with the front channel is connected to an ink source. The laminar air flow chamber is provided with an air intake connected to a pressurized air supply directing an airstream to a point between the front and rear channels so that the air stream makes a sharp turn at the entry into the front channel resulting in a pressure gradient in the discharge path. An electric field is established by a first electrode proximate to the front channel and a second electrode on a rear side wall at the insulative plate such that, combined with the affects of the pressure gradient, the ink meniscus at the exit end of the rear channel is caused to extend toward the front channel and be torn apart into a droplet carried by the airstream and discharged through the front channel.

Various problems have been identified with respect to air pressure assisted ink jet print head mechanisms. It has been determined that a zone of stagnant air exists around the area of the drop forming orifice which allows a puddle of ink to form there. The pressure forced ink, which must break through the stagnant air, may be significantly deformed thereby, resulting in fuzzy, irregular print lines or otherwise adversely effected print quality.

Non-air assisted, as well as air assisted, ink jet printing heads have associated therewith print quality problems caused by ink wetting the drop forming orifice. Such ink wetting problems have been addressed by applying anti-wetting coatings, such as polytetrafluoroethylene, to the drop forming orifice. However, such a coating provides only a temporary solution because over time the anti-wetting coating becomes contaminated and loses its anti-wetting characteristics.

More recent studies suggest that the structure or shape of an ink jet print head drop forming orifice can significantly impact the quality of printing resulting therefrom. It has been suggested that a "mesa" structure or print head drop forming orifice which is provided in a structure of a frustoconical profile can provide drops with enhanced uniformity resulting in better quality ink jet printing.

SUMMARY OF THE INVENTION

The present invention is a method for electroforming nozzle plates having three dimensional structural features. Through use of photolithographic techniques, an opaque, conductive coating is applied to the surface of a transparent mandrel. The coating has a pattern of holes corresponding to the final sizes and locations of the desired nozzle plate holes. Again through use of photolithographic techniques, a pattern of thin masked areas are concentrically formed from a non-conductive, transparent material over each hole formed in the opaque, conductive coating. A thick photoresist layer is applied over the opaque, conductive coating and the pattern of masked areas and is exposed from the back side of the transparent mandrel to form a pattern of cured photoresist posts. The posts have diameters corresponding to the diameters of the desired nozzle holes, and are located at the desired locations of the nozzle holes.

A layer of a first metal is then plated onto the conductive coating on the transparent mandrel. Because the transparent masked areas are thin, the first metal layer overgrows the edges of the masked areas. The plating process is stopped when the overgrowths of the first metal layer approach the photoresist posts. A first layer of a second metal is then plated over the first metal layer until the first layer of the second metal surrounds but does not cover the photoresist posts. The photoresist posts and masked areas cause depressions to be formed in the metal layers, which are then filled with a planarizing filler and lapped or polished as necessary to create a smooth, continuous surface on the top of the plated layers.

A thick layer of photoresist is applied over the top of the smooth plated layers and cured so as to form a pattern of thick photoresist discs covering and in registration with the filled depressions. A second layer of the second metal is then plated over the first layer of the second metal until the second metal layer of the second metal approaches the top of the photoresist discs.

The plated layers are then separated from the transparent mandrel, and using suitable stripping and/or etching materials, the opaque, conductive coating, the non-conductive, transparent masked areas, the first metal, the photoresist posts, the planarizing filler areas and the photoresist discs are removed. The result is a nozzle plate formed of two electroformed layers of metal and having a pattern of closely spaced extended nozzle holes or ink drop forming orifices of a small diameter contained in three dimensional mesa-like structures providing enhanced ink jet printing quality.

BRIEF DESCRIPTION OF THE DRAWINGS

A more complete understanding of the present invention is possible by reference to the following detailed description considered in conjunction with the accompanying drawings, in which.

DETAILED DESCRIPTION OF THE INVENTION

Figure 1:
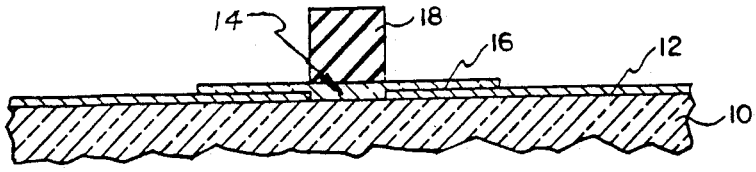
FIGS. 1 through 6 are diagrammatic representations, shown in cross-section, of a method for electroforming nozzle plates having three dimensional features in accordance with the present invention.

Referring now to the drawings wherein like reference numerals designate corresponding or similar elements throughout the several views, a method for fabricating nozzle plates having three dimensional features is shown. Referring to FIG. 1, onto a transparent glass mandrel 10, an opaque, conductive coating 12, such as INCONEL (TM), is applied by photolithographic techniques to a thickness of 2000 Angstroms. The opaque coating 12 is applied such that a pattern of holes 14 in the locations and of the diameters of the desired nozzle plate holes, typically 0.002", are formed in the opaque coating 12, and such that other areas not to be plated during fabrication of the plate, such as borders and areas corresponding to the mounting holes of the plate, are not covered by the opaque coating 12.

Again, through use of photolithographic techniques, a pattern of thin, approximately 3000–4000 Angstroms, circular masked areas 16 of a non-conductive, transparent material, such as Al $0_2$, are formed on the opaque coating 12 over each nozzle hole location 14 in the opaque coating 12. The circular masked areas 16 are of a diameter determined by the desired thickness of the first metal plus the nozzle plus the walls, typically all totalling about 0.012".

A layer of photoresist, about 0.003" thick, is applied by known techniques over the opaque, conductive coating 12 and the non-conductive, transparent masked areas 16 and is exposed from the backside of the transparent glass mandrel 10 through the holes 14 in the opaque coating 12 and through the transparent masked areas 16. Development of the photoresist layer forms a pattern of cured photoresist posts 18 in registration with the corresponding holes 14 in the opaque, conductive coating 12. The photoresist posts 18 have locations and diameters corresponding to the locations and diameters of the desired nozzle plate holes.

Figure 2:
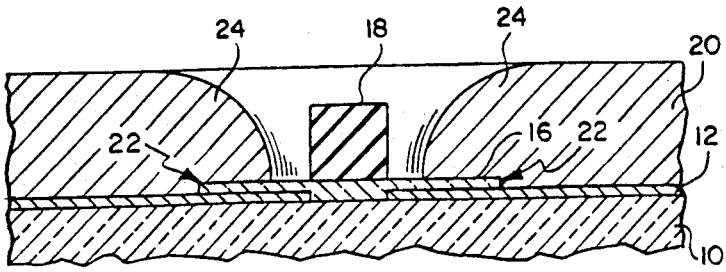

Referring to FIG. 2, a layer of a first metal 20, typically copper, is plated onto the conductive opaque coating 12 on the glass mandrel 10 to a thickness of about 0.004". Because the first metal 20 only plates the exposed areas of the conductive coating 12, the first metal 20 does not directly plate the portions of the conductive coating 12 covered by the non-conductive, transparent masked areas 16 and the areas of the mandrel not coated with the conductive coating 12. The non-conductive, transparent masked areas 16 are very thin, however; therefore, the first metal 20 plating overgrows the edges 22 of the masked areas 16. The plating process is stopped only after the first metal 20 overgrowth 24 approaches about 0.001" from the photoresist posts 18.

Figure 3:
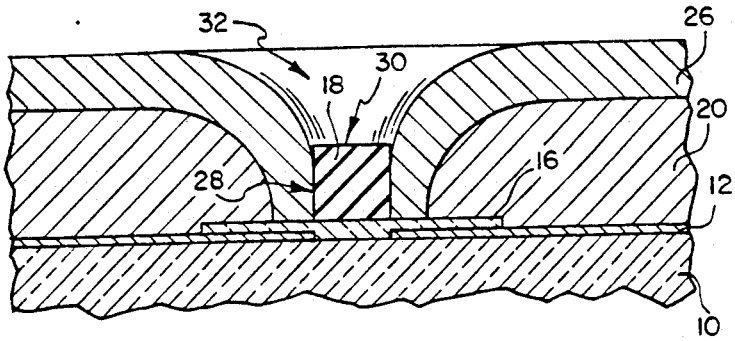

Referring to FIG. 3, a first layer 26 of a second metal, typically nickel, is then electroplated to a thickness of about 0.002" over the first metal layer 20. The first layer 26 of the second metal is plated until it completely surrounds but does not cover the photoresist posts 18. The second metal 26 is plated against the sidewalls 28 of the photoresist posts 18, plating up the posts about 0.002"–0.003", but is not allowed to overcoat the top 30 of the posts. As can be seen in FIG. 3, the photoresist posts 18 form the desired nozzle holes in the layer of second metal 26, and with the non-conductive masked areas 16 form conical depressions in the layers of the first and second metals in registration with the pattern of desired nozzle holes.

Figure 4:
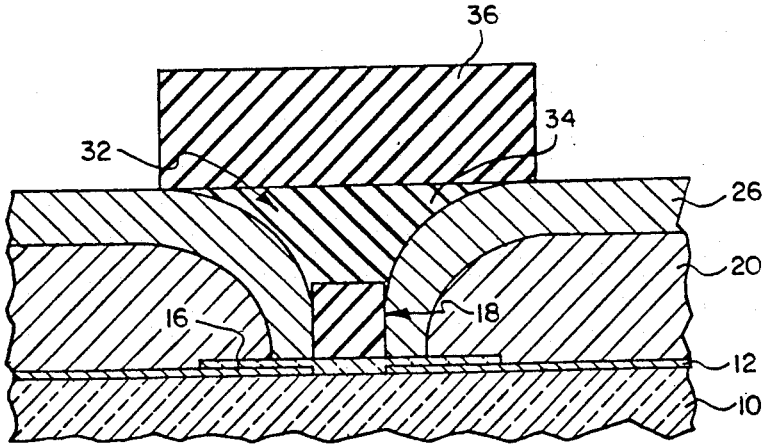

Referring now to FIG. 4, the conical depressions 32 are filled with a planarizing material 34, which is lapped or polished as necessary to create a smooth, continuous surface on the top of the plated second metal layer. The planarizing material 34 may be either a conducting or non-conducting material, such as wax or solder. A layer of photoresist about 0.004" thick, is then applied over the second metal layer 26 and the planarizing material 34, and is exposed and developed by well known techniques to form a pattern of circular photoresist discs 36 in registration with the conical depressions 32. The discs 36 completely cover the the filled conical depressions 32.

Figure 5:
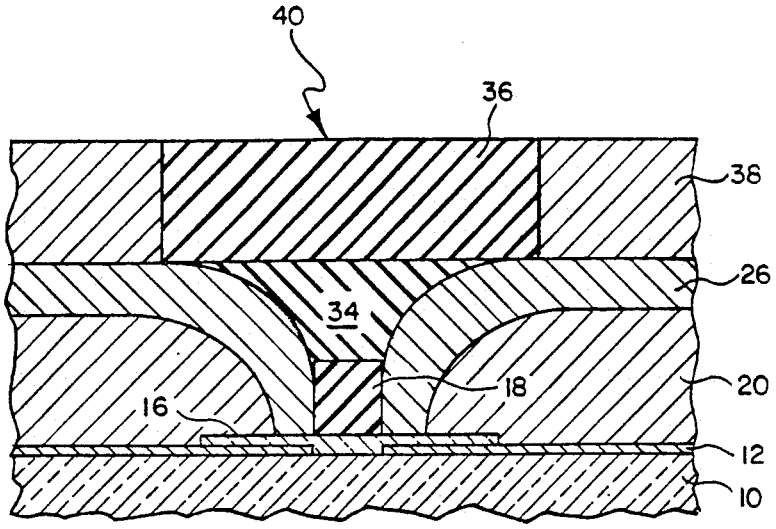

Referring to FIG. 5, a second layer 38, about 0.003" thick, of the second metal, nickel, is electroformed onto the first layer 26 of the second metal until the second layer 38 approaches the top 40 of the photoresist discs 36. All of the plated layers 20, 26 and 38 are then separated from the glass mandrel 10, and the photoresist discs 36, planarizing material 34, photoresist posts 18, non-conductive, transparent masked areas 16 and opaque, conductive coating 12 are dissolved away from the plated layers using suitable stripping materials. Finally, through use of an acid which does not attack the electroformed layers 26 and 38 of the second metal, the first metal 20 layer is etched away from the layers 26 and 38 of the second metal.

Figure 6:
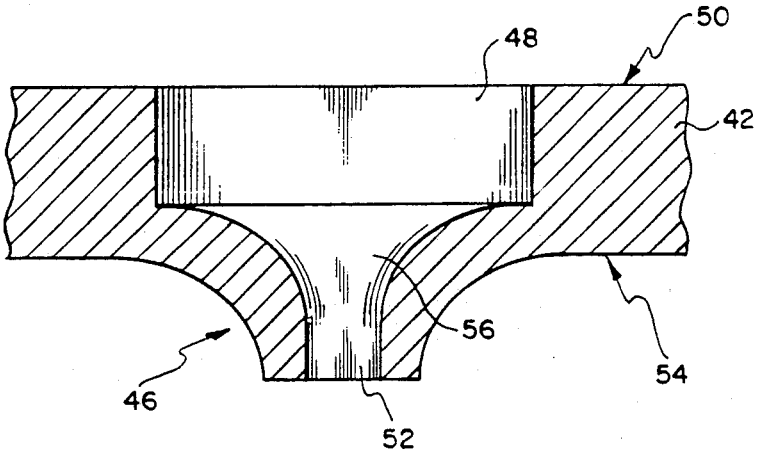

As can be seen in FIG. 6, the result is a metal plate 42 having a plurality of holes defined by thin-walled, three dimensional nozzles 46. Each nozzle includes a wide well 48 opening to the back surface 50 of the plate, a narrow nozzle jet 52 of a precise selected diameter opening from the front surface 54 of the plate and a conical transition area 56 leading from the wide diameter well 48 to the precise-diameter nozzle jet 52.

The above description is given by way of example and is a preferred embodiment of the present invention. However, it occur to those skilled in the art that modifications and alternatives of the above are possible. It is therefore intended that the scope of the present invention only be limited by the following claims.

What is claimed is:

1. A method for fabricating a nozzle plate having a plurality of holes, comprising the steps of:

applying onto a transparent mandrel a coating of an opaque, conductive material having a pattern of holes of selected diameters and at selected locations corresponding to the diameters and locations of the holes of the nozzle plate;

applying over said holes in said opaque, conductive coating, a non-conductive, transparent material to form a plurality of masked areas of selected dimensions, each area over one of said holes;

applying a layer of photoresist of selected thickness over said opaque, conductive coating and said non-conductive, transparent masked areas;

exposing said layer of photoresist from the backside of said transparent mandrel through said holes in said opaque, conductive coating and through said non-conductive, transparent masked areas to form on said masked areas a plurality of raised photoresist posts of selected dimensions, each post over one of said masked areas and in registration with said holes in said opaque, conductive material;

electroforming to a desired thickness a layer of a first metal onto said opaque, conductive coating until said layer of said first metal overgrows said masked areas by a selected amount;

electroforming to a desired thickness a first layer of a second metal over said layer of said first metal until said first layer of said second metal plates around said photoresist posts a desired amount, and wherein depressions are formed in said first and second metal layers in registration with said masked areas and said photoresist posts;

filling said depressions with a planarizing material to form a plurality of filled depressions;

applying a layer of photoresist of a selected thickness onto said first layer of said second metal and said filled depressions;

exposing said layer of photoresist to form a plurality of cured photoresist discs of select dimensions, each disc in registration with one of said filled depressions;

electroforming to a desired thickness a second layer of said second metal onto said first layer of said second metal;

separating said layers of said first and second metals, said non-conductive, transparent masked areas and said opaque, conductive coating from said transparent mandrel; and removing said layer of said first metal, said non-conductive, transparent masked areas and said opaque, conductive coating from said first and second layers of said second metal.

2. The method of claim 1, wherein said first metal is copper.

3. The method of claim 4, wherein said second metal is nickel.

4. A method for fabricating a nozzle plate having a plurality of holes, comprising the steps of:

forming on a conductive surface a plurality of non-conductive masked areas of selected dimensions, each area at a location corresponding to the location of one of the holes of the nozzle plate;

creating on said masked areas a plurality of raised photoresist posts of selected dimensions, each post over one of said masked areas and in the location of one of the holes of the nozzle plate;

electroforming to a desired thickness a layer of a first metal onto said conductive surface until said layer of said first metal overgrows said masked areas by a selected amount;

electroforming to a desired thickness a first layer of a second metal over said layer of said first metal until said first layer of said second metal plates around said photoresist posts a desired amount, and wherein depressions are formed in said first and second metal layers in registration with said masked areas and said photoresist posts;

filling said depressions with a planarizing material to form a plurality of filled depressions;

creating on said plurality of filled depressions a plurality of photoresist discs of selected dimensions, each disc is registration with one of said filled depressions;

electroforming to a desired thickness a second layer of said second metal onto said first layer of said second metal;

separating said layers of said first and second metals and said masked areas from said conductive surface; and removing said layer of said first metal and said masked areas from said first and second layers of said second metal.

5. The method of claim 4, wherein said first metal is copper.

6. The method of claim 4, wherein said second metal is nickel.

7. A method for fabricating a nozzle plate having a plurality of holes, comprising the steps of:

forming on a conductive surface a plurality of non-conductive masked areas of selected dimensions, each area at a location corresponding to the location of one of the holes of the nozzle plate;

electroforming to a desired thickness a layer of a first metal onto said surface until said layer of said first metal overgrows said masked areas by a selected amount;

electroforming to a desired thickness a first layer of a second metal over said layer of said first metal until a plurality of holes having diameters corresponding to the diameters of the holes of the nozzle plate are formed in said first layer of said second metal, and wherein depressions are formed in the first and second metal layers in registration with said holes formed in said first layer of said second metal;

electroforming to a desired thickness onto said first layer of said second metal, a second layer of said second metal, said second layer of said second metal having a plurality of holes in registration with said depressions, each hole of a select diameter larger than said holes in said first layer of said second metal;

separating said layers of said first and second metals and said non-conductive masked areas from said conductive surface; and removing said layer of said first metal and said non-conductive masked areas from said first and second layers of said second metal.

8. The method of claim 7, wherein said first metal is copper.

9. The method of claim 7, wherein said second metal is nickel.

* * * * *